US007153014B1

(12) United States Patent
Kuhner

(10) Patent No.: US 7,153,014 B1
(45) Date of Patent: Dec. 26, 2006

(54) KNITE-LITE

(76) Inventor: Randy Kuhner, 130 Vance St., Browns Mills, NJ (US) 08015

( * ) Notice: Subject to any disclaimer, the term of this patent is extended or adjusted under 35 U.S.C. 154(b) by 35 days.

(21) Appl. No.: 11/000,606

(22) Filed: Dec. 1, 2004

Related U.S. Application Data

(60) Provisional application No. 60/530,192, filed on Dec. 18, 2003.

(51) Int. Cl.
*F21V 29/00* (2006.01)

(52) U.S. Cl. ..... 362/544; 362/543; 362/231; 40/543

(58) Field of Classification Search ..... 362/510, 362/543, 544, 545, 231, 512; 40/543
See application file for complete search history.

(56) References Cited

U.S. PATENT DOCUMENTS

| | | | | |
|---|---|---|---|---|
| 3,105,954 | A * | 10/1963 | Gill, Jr. | 40/543 |
| 4,172,063 | A | 10/1979 | O'Brill | |
| 4,361,202 | A | 11/1982 | Minovitch | |
| 4,970,628 | A * | 11/1990 | Bergkvist | 362/510 |
| 5,448,453 | A * | 9/1995 | Oshio | 362/510 |
| 6,207,077 | B1 | 3/2001 | Burnell-Jones | |

* cited by examiner

*Primary Examiner*—Stephen F Husar

(57) ABSTRACT

A lighting system for use in conjunction with vehicles and road paint. The lighting system comprises having a black light/white light combination in each headlight well of a vehicle, along with having various sections of road signs that includes fluorescent paint, with the paint including a chemical known as phospors.

4 Claims, 3 Drawing Sheets

KNITE-LITE

I. CROSS-REFERENCE TO RELATED APPLICATIONS

This application claims the benefit of U.S. Provisional Application No. 60/530,192, filed Dec. 18, 2003.

II. BACKGROUND OF THE INVENTION

The present invention concerns that of a new and improved lighting system for use in conjunction with vehicles and road paint.

III. DESCRIPTION OF THE PRIOR ART

U.S. Pat. No. 6,207,077, issued to Burnell-Jones, discloses luminescent, phosphorescent pigment for such uses as lane markers.

U.S. Pat. No. 4,361,202 issued to Minovitch, discloses an automobile transportation guiding system and is provided for general interest in the art.

U.S. Pat. No. 4,172,063, issued to O'Brill, discloses an abrasion resistant reflective marking composition for use on highways and runaways and illuminated with black light to produce a glowing effect.

IV. SUMMARY OF THE INVENTION

The present invention concerns that of a new and improved lighting system for use in conjunction with vehicles and road paint. The lighting system comprises having a black light/white light combination in each headlight well of a vehicle, along with having various sections of road signs that includes fluorescent paint, with the paint including a chemical known as phospors.

There has thus been outlined, rather broadly, the more important features of a lighting system for vehicles that the detailed description thereof that follows may be better understood and in order that the present contribution to the art may be better appreciated. There are, of course, additional features of the lighting system for vehicles that will be described hereinafter and which will form the subject matter of the claims appended hereto.

In this respect, before explaining at least one embodiment of the lighting system for vehicles in detail, it is to be understood that the lighting system for vehicles is not limited in its application to the details of construction and to the arrangements of the components set forth in the following description or illustrated in the drawings. The lighting system for vehicles is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present lighting system for vehicles. It is important, therefore, that the claims be regarded as including such equivalent constructions insofar as they do not depart from the spirit and scope of the present invention.

It is therefore an object of the present invention to provide a lighting system for vehicles which has all of the advantages of the prior art and none of the disadvantages.

It is another object of the present invention to provide a lighting system for vehicles which may be easily and efficiently manufactured and marketed.

It is another object of the present invention to provide a lighting system for vehicles which is of durable and reliable construction.

It is yet another object of the present invention to provide a lighting system for vehicles which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
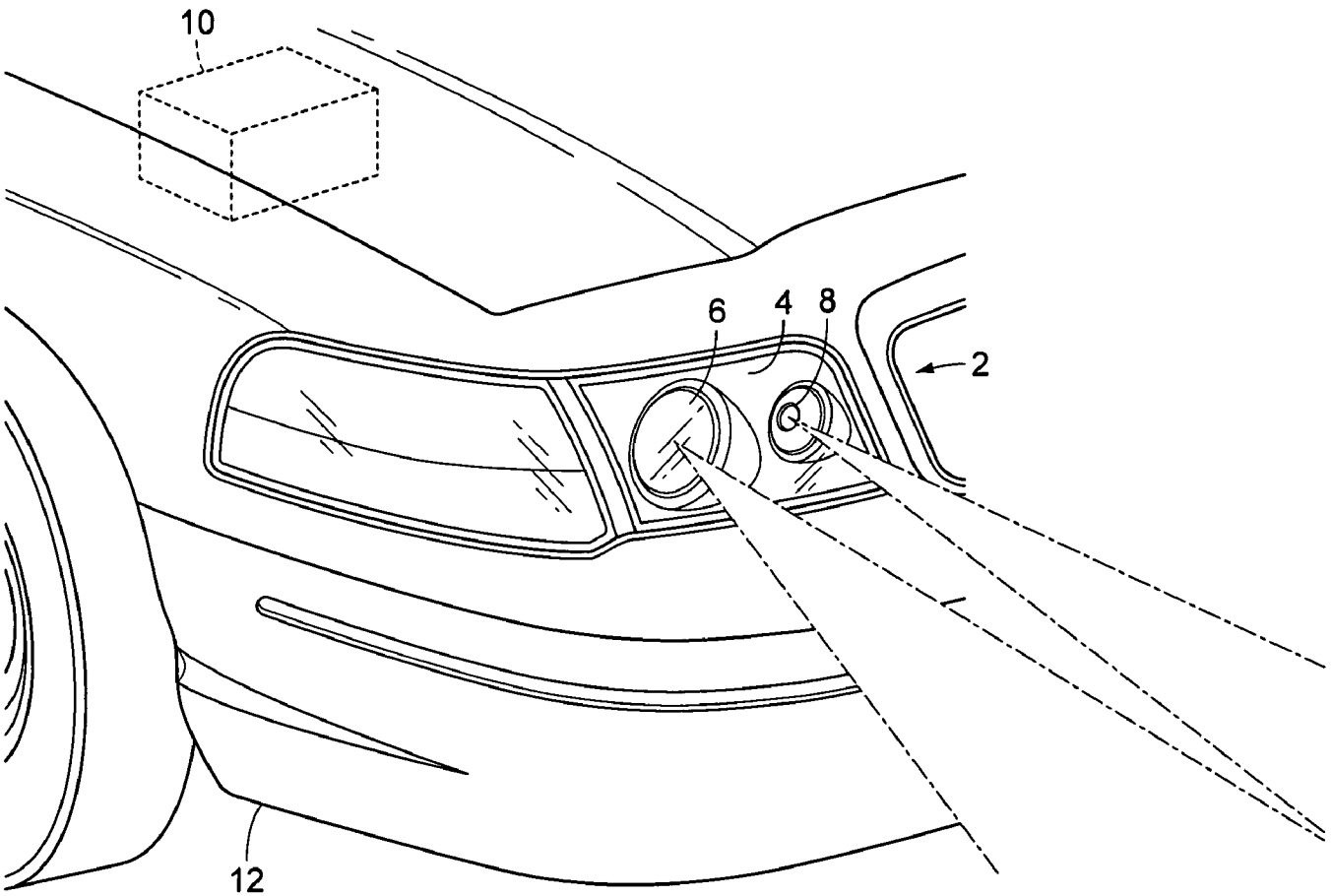
FIG. 1 shows a close-up perspective view of a vehicle headlight well.

FIG. 1 shows a close-up perspective view of a vehicle headlight well 2. Each well 2 is a cavity that is covered by a plastic covering 4. Well 2 has at least two lights, comprising a regular white light 6 and a black light 8. The so-called "black light," when activated, emits both purple light and ultraviolet light, which is not visible by humans. There would be two wells 2 on a vehicle, one on each side.

White light 6 and black light 8 are connected to a power source 10 within the attached vehicle 12, with the power source 10 preferably being the battery of a vehicle 12. Generally, there is an on/off switch 14 that is located within the vehicle that acts as a circuit in between the power source 10 and white light 6 and black light 8. Each well 4 has one white light 6 and one black light 8.

Figure 2:
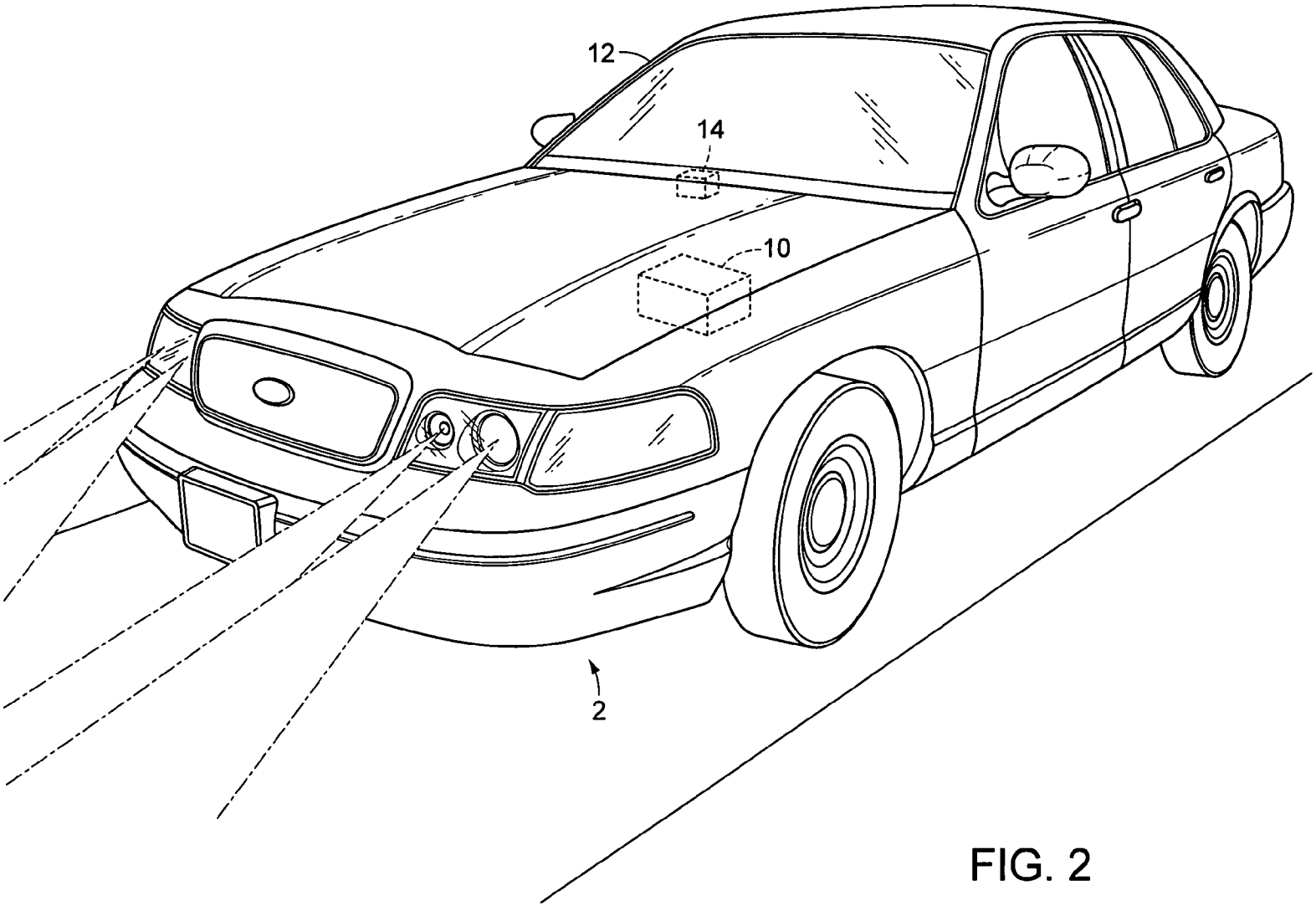
FIG. 2 shows a perspective view of a vehicle with a pair of headlight wells in use.

FIG. 2 shows a perspective view of a vehicle with a pair of headlight wells 2 in use. Each headlight wells has at least one white light 6 and one black light 8. Once the on/off switch 14 within the vehicle has been activated, all white lights 6 and black lights 8 within both wells 2 will turn on, emitting rays of light in a forward manner. The light emitted by each white light 6 and black light 8 within each well 2 will emit separate beams, but since they will be facing the same direction, will cause just one beam of light to carry forward.

Figure 4:
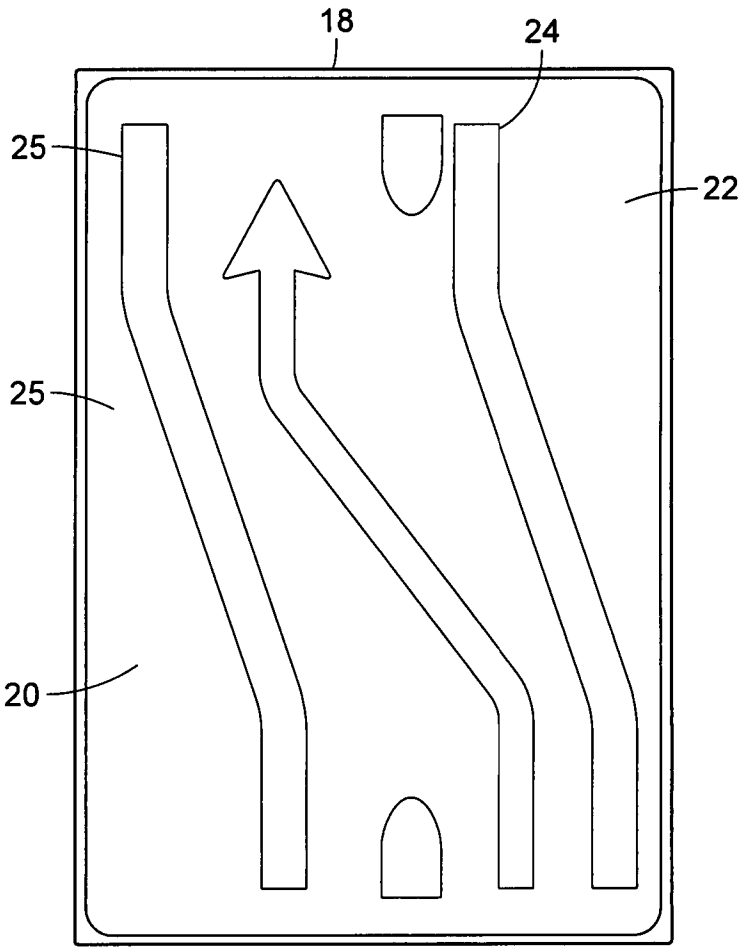
FIGS. 3 and 4 show views of a particular sign on the ground with and without use of the vehicle headlights, respectively, of the present invention.
Figure 3:
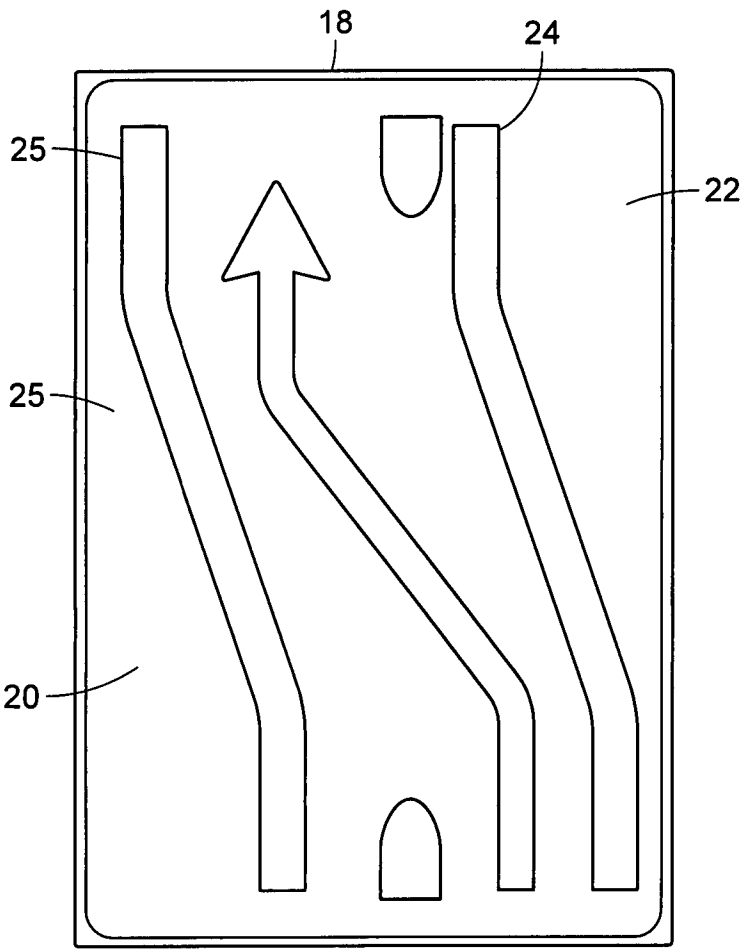

FIGS. 3 and 4 show views of a particular sign 18 on the ground with and without use of the vehicle headlights, respectively, of the present invention. Each sign 18 is fabricated from paint 20 that includes a chemical known as phospors 25, which glows when it is radiated with ultraviolet light. In the sign 18 shown in FIGS. 3 and 4, only the yellow paint 22 and red paint 24 have incorporated phospors 25. FIG. 3 shows the sign 18 as it would appear when both the white light 6 and the black light 8 from at least one well 2 of the present invention shines upon it. FIG. 4 shows the sign 18 as it would appear when only a white light from a regular headlight shines upon it. As can be seen in FIG. 4, when regular white light is the only method used to illuminate the sign 18, the yellow and red barely light up. The sign 18 in this instance is still visible, but it is much more difficult to view.

What I claim as my invention is:

1. A lighting system for driving in reduced light conditions in combination with a vehicle, the lighting system comprising:

a first headlight well located on the vehicle, a first white light located within the first headlight well, a first black light located within the first headlight well, the first white light and the first black light merging into a single beam of light, a plastic covering located over the first headlight well, a power source located within the vehicle, an on/off switch located within the vehicle, the on/off switch being connected to the white lights and the black lights, the on/off switch also connected to the power source, at least one road sign, a volume of paint, the volume of paint used to paint on the road sign, an amount of chemical mixed in with the volume of paint, the chemical capable of glowing when exposed to black light, wherein shining the white light and the black light from the vehicle on the road sign will cause the volume of paint and the chemical to light up, providing better visibility to a driver of the vehicle.

2. A lighting system according to claim 1 wherein the power source located within the vehicle is a vehicle battery.

3. A lighting system according to claim 1 wherein the chemical mixed in with the volume of paint is phosphors.

4. A lighting system according to claim 1 and further comprising:

a second headlight well located on the vehicle, the second headlight well spaced from the first headlight well, a second white light located within the second headlight well, a second black light located within the second headlight well, the second white light and the second black light emitting merging into a single beam of light, and a plastic covering located over the second headlight well.

* * * * *